United States Patent [19]

Zielinski

[11] 4,138,748

[45] Feb. 13, 1979

[54] HYDRAULIC OPERATOR FOR WATER CLOSET

[75] Inventor: Stefan Zielinski, Burlingame, Calif.

[73] Assignee: Aluminum Plumbing Fixture Corp., Burlingame, Calif.

[21] Appl. No.: 836,306

[22] Filed: Sep. 26, 1977

[51] Int. Cl.[2] ..... E03D 11/12

[52] U.S. Cl. ..... 4/312; 4/DIG. 2

[58] Field of Search ..... 4/DIG. 2, 312, 1

[56] References Cited

U.S. PATENT DOCUMENTS

| | | | |
|---|---|---|---|
| 2,184,722 | 12/1939 | McLoughlin | 4/DIG. 2 |
| 2,443,214 | 6/1948 | Williams | 4/DIG. 2 |
| 3,092,844 | 6/1963 | Brunson | 4/172.13 |
| 3,436,764 | 4/1969 | Colonna | 4/312 |
| 3,564,622 | 2/1971 | Meulekamp | 4/172.13 |
| 3,670,343 | 6/1972 | Gansloser | 4/172.13 |
| 3,887,947 | 6/1965 | Tosca | 4/1 |

*Primary Examiner*—Henry K. Artis

*Attorney, Agent, or Firm*—Robert G. Slick

[57] ABSTRACT

A hydraulic cylinder operated by ordinary home water pressure is used to actuate a swinging water closet. In accordance with a preferred embodiment of the invention, the water pressure and water discharge is obtained by a simple modification of a standard flush valve.

1 Claim, 3 Drawing Figures

HYDRAULIC OPERATOR FOR WATER CLOSET

SUMMARY OF THE INVENTION

Water closets are ordinarily unsightly and in many applications where the water closet would otherwise be exposed, as in a bedroom, it has been common practice to provide a water closet which pivots between two positions, one of which permits the closet to be used in the normal way and the other to a position within a cabinet. Thus, an attractive fixture is provided so that it is suitable for use in hospital rooms, rest homes and similar locations.

One difficulty with such water closets in the past has been that the closets are frequently used by aged or infirm people and it requires a substantial amount of effort to swing the water closet between the two positions. Although electric operating means have been proposed, these have required various safety controls, such as limit switches, and have also greatly increased the cost of installation since electricians as well as plumbers 1 must be employed to make the installation.

In accordance with the present invention, a simple actuator for a swinging water closet is provided which operates from ordinary water pressure which is available for the flushing operation of the water closet.

An advantage of the present invention is that the water pressure is employed to maintain the fixture in one of two selected positions so that there is no danger of the fixture drifting or swinging out of position. This is particularly important when the fixture is used by aged or infirm people wherein any instability of the fixture would be dangerous.

In accordance with a preferred embodiment of the invention, the pressure for actuating the fixture is obtained from an ordinary flush valve and the valve also receives the discharged water at the completion of a cycle.

Various other features and advantages of the invention will be brought out in the balance of the specification.

DESCRIPTION OF THE PREFERRED EMBODIMEMTS

Figure 1:
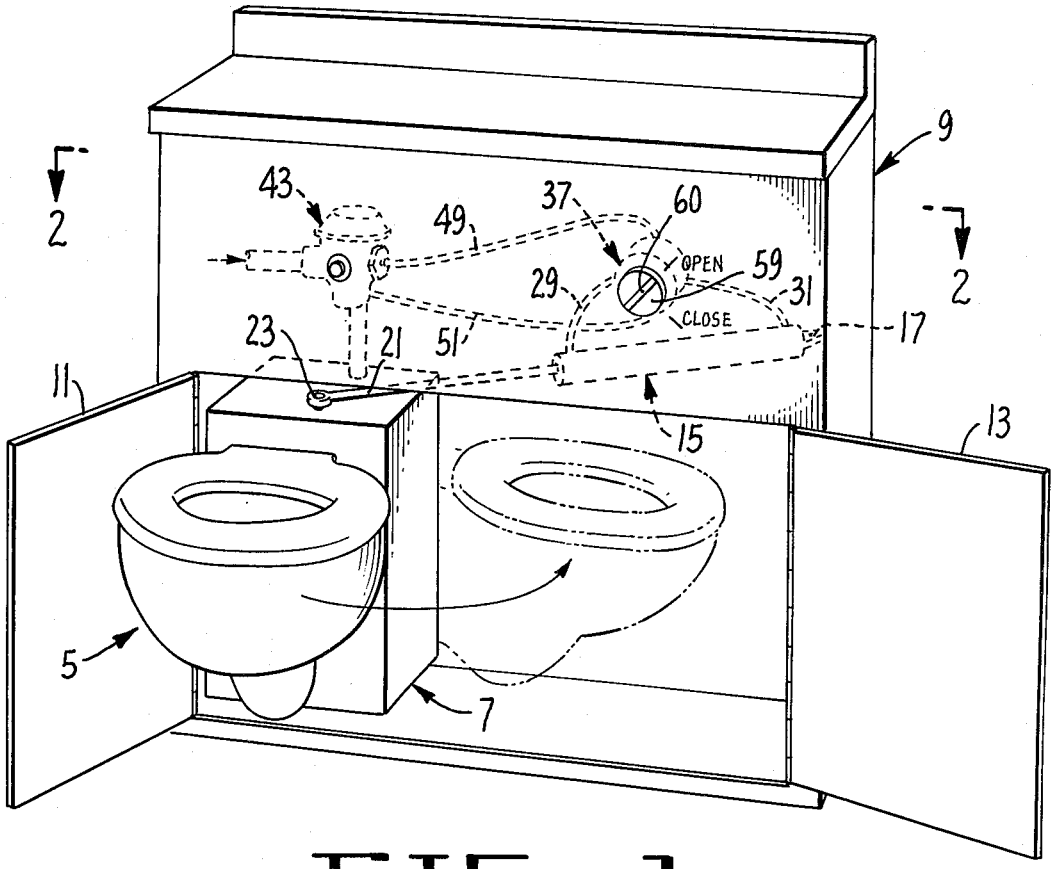
FIG. 1 is a perspective view of a water closet embodying the present invention.
Figure 2:
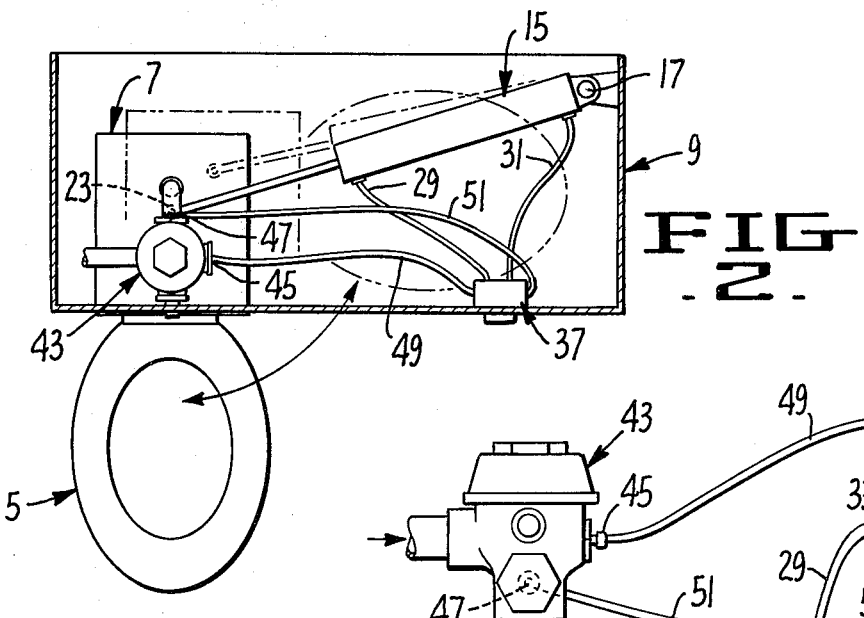
FIG. 2 is a section on the line 2-2 of FIG. 1.

Referring now to the drawings by reference characters, the water closet 5 is mounted on a moving base member 7 which is provided with a vertical pivot, not illustrated. The closet 5 and base member 7 can pivot between two positions, namely an operative position shown in solid lines, and an inoperative position shown in dot-dash lines. The structure may be mounted within a cabinet generally designated 9 which extends from a wall or it may be mounted in a recessed manner so that the front surface of the cabinet is flush with the wall. Cabinet 9 may also contain a wash basin, either on the top surface or extending out from the front surface.

Doors 11 and 13 are hinged on the front of the cabinet and they can be opened to allow the water closet to be pivoted out and used or closed to conceal the closet when it is in the inoperative position.

In accordance with the present invention, a hydraulic cylinder generally designated 15 is employed to actuate the closet between the two positions. Cylinder 15 is pivoted at 17 on a fixed member of the cabinet. The cylinder is provided with the usual piston 19 to which is attached the piston rod 21 and this is also pivoted at 23 on the member 7. The hydraulic cylinder is provided with two ports 25 and 27, either of which can serve as an inlet or outlet port. Lines 29 and 31 connect these ports to opposed ports 33 and 35 on a two-way rotary valve 37. The rotary valve has two additional ports 39 and 41 which are displaced 90° from the first mentioned ports. A standard flush valve 43 is modified by providing an outlet 45 on the high pressure (inlet) side of the valve and an inlet 47 on the low pressure (discharge) side of the valve. Line 49 connects the high pressure side to port 41 while line 51 connects ports 39 to the low pressure side. Valve 37 has a body 53 which is rotatable between two positions 90° apart, and has passages 55 and 57 adapted to link adjacent ports. The valve body is provided with an operating handle 59 which extends from the front of the cabinet and the mark 60 tells the user the position of the valve.

Figure 3:
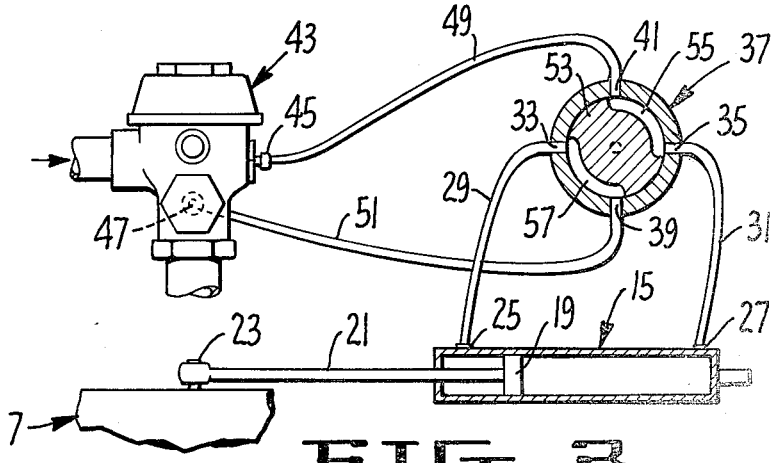
FIG. 3 is a flow diagram of the operating mechanism.

When the valve body is in the position shown in FIG. 3, the high pressure line 49 is connected to port 27 so that piston 19 is pushed outwardly, holding the water closet in the extended position. The water pressure is maintained at all times so that there is no instability on the part of the water closet making it extremely suitable for use by aged or infirm people. As the piston moves to open the closet, water from the previous cycle discharges through lines 29 and 51 and flows out through the opening 47 of the flush valve 43.

Upon the completion of use, the valve body 53 is rotated 90° so that port 35 is now connected to port 39 and 33 is connected to port 31. Now the water pressure is applied to the front side of piston 19, causing the closet to withdraw into the cabinet and water is discharged through lines 31 and 51 and into the opening 47.

The volume of water used for actuating the mechanism is very small.

It is believed apparent from the foregoing that I have provided a simple and effective way of actuating a water closet making it easy to use, particularly by aged or infirm people and which avoids electrical connections.

I claim:

1. In a water closet mounted for pivoting in a horizontal plane from a first position to a second position relative to a fixed mounting and provided with a source of water for flushing, the improvement comprising:

a. an hydraulic cylinder attached between said fixed mounting of said water closet and a point on said water closet, b. a flush valve having an inlet side connected to said water source and a discharge side, c. conduit means connecting the inlet and discharge sides of the flush valve to opposite sides of the hydraulic cylinder, and d. control means for selectively reversing the conduit connections between the flush valve and the hydraulic cylinder to pivot the water closet between said first and second positions.

* * * * *